US007082355B1

(12) United States Patent
Jacobson

(10) Patent No.: US 7,082,355 B1
(45) Date of Patent: Jul. 25, 2006

(54) WAKE WASH SEVERITY MONITOR FOR HIGH SPEED VESSELS

(75) Inventor: Donald R. Jacobson, Virginia Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 172 days.

(21) Appl. No.: 10/943,828

(22) Filed: Sep. 14, 2004

(51) Int. Cl.
*G06F 17/00* (2006.01)

(52) U.S. Cl. ..... 701/21; 340/985

(58) Field of Classification Search ..... None
See application file for complete search history.

(56) References Cited

U.S. PATENT DOCUMENTS 6,171,021 B1 1/2001 Feldtmann ..... 405/15

OTHER PUBLICATIONS

Trevor Whittaker, Bjorn Elsaber, "Coping with the wash: The nature of wash waves produced by fast ferries," *Ingenia*, quarterly of the Royal Academy of Engineering, Issue 11, Feb. 2002, pp. 40-44.

Trevor Whittaker, A. Bell, M. Shaw, K. Patterson, "An investigation of fast ferry wash in confined waters," paper No. 13, presented at the International Conference of Hydrodynamics of High Speed Craft, Royal Institution of Naval Architects (RINA), London, England, Nov. 24-25, 1999 (13 pages).

I.W. Dand, T.A. Dinham-Peren, L. King, "Hydrodynamic aspects of a fast catamaran operating in shallow water," paper No. 11, presented at the International Conference of Hydrodynamics of High Speed Craft, Royal Institution of Naval Architects (RINA), London, England, Nov. 24-25, 1999 (17 pages).

Alan Blume, "High-speed vessel wake wash," slide presentation presented at Ship Effects Workshop, U.S. Army Engineer Research and Development Center (ERDC), Gulfport, Mississippi, Oct. 29-30, 2002 (15 pages); available online, in the U.S. Army's Coastal and Hydraulics Laboratory website, at http://ch1.wes.army.mil/research/navigation/GulfportWorkshop/AlanBlume.pdf, printed out on or about Jul. 21, 2004.

(Continued)

*Primary Examiner*—Michael J. Zanelli
(74) *Attorney, Agent, or Firm*—Howard Kaiser

(57) ABSTRACT

Onboard a marine vessel in transit a speedometer, a fathometer and a computer run in conjunction to track the Froude depth number (which is a function of vessel speed and water depth). A warning (e.g., display, signal and/or alarm) appears and/or sounds when the vessel nears or approaches the critical Froude depth number value of one (which is associated with wake wash at its most deleterious level), thus alerting the crew that the vessel's speed must be adjusted (usually, reduced) in order to avoid Froude depth number criticality. Typical embodiments establish a Froude depth number threshold value below 1.0 (e.g., 0.8), above which a red (prohibitive) zone warning is given. Some embodiments additionally establish a Froude depth number value above 1.0 (e.g., 1.2), below which a red (prohibitive) zone warning is given, above which an yellow (cautionary) zone warning (appreciably different from the red zone warning) is given.

23 Claims, 5 Drawing Sheets

OTHER PUBLICATIONS

G.J. Macfarlane and M.R. Renilson, "When is low wash low wash—an investigation using a wave wake database," presented at the International Conference on Hydrodynamics for High Speed Craft—Wake Wash and Motions Control, Royal Institution of Naval Architects (RINA), London, England, Nov. 7-8, 2000 (14 pages).

David Kriebel, William Seling, Carolyn Judge, "Development of a unified description of ship generated waves," slide presentation presented on Oct. 29, 2003 at the Proceedings Of The U.S. Section PIANC Annual Meeting, Roundtable, And Technical Workshops, Portland Marriott Downtown Hotel, Portland, Oregon, Oct. 28-30, 2003, slide presentation presented on Wednesday Oct. 29, 2003 (37 pages); available online, in the U.S. Army Corp of Engineers'Institute for Water Resources website, at http://www.iwr.usace.army.mil/newpianc/Presentations/portland_proceedings_presentations/PassingShipsWkshp.pdf, printed out on or about Jul. 21, 2004.

"A physical study of fast ferry wash characteristics in shallow water," Final Report, Research Project 457, 2000, The Maritime and Coastguard Agency (United Kingdom), Nov. 2001 (115 pages); available online, in the Queen's University Belfast website, at http://www.qub.ac.uk/waves/fastferry/reference/MCA457.pdf, printed out on or about Jul. 21, 2004.

R Allen and R. Clements, "Ship wash impact management (SWIM)," presented at the Sixth International Conference on Fast Sea Transportation (FAST 2001), Royal Institution of Naval Architects (RINA), London, England, Sep. 4-6, 2001, pp. 91-96.

R. Doyle, T. Whittaker, B. Elsaber, "A Study of fast ferry wash in shallow water," presented at the Sixth International Conference on Fast Sea Transportation (FAST 2001) Conference, Royal Institution of Naval Architects (RINA), London, England, Sep. 4-6, 2001, pp. 107-119.

A. Bell, B. Elsaesser, T. Whittaker, "Environmental impact of fast ferry wash in shallow water," presented at the International Conference on Hydrodynamics for High Speed Craft—Wake Wash and Motions Control, Royal Institution of Naval Architects (RINA), London, England, Nov. 7-8, 2000 (21 pages).

T. Whittaker, R. Doyle, B. Elsaesser, "A study of the leading long period waves in fast ferry wash," presented at the International Conference on Hydrodynamics for High Speed Craft—Wake Wash and Motions Control, Royal Institution of Naval Architects (RINA), London, England, Nov. 7-8, 2000 (18 pages).

T. Whittaker, R. Doyle, B. Elsaber, "An experimental investigation of the physical characteristics of fast ferry wash," presented at the Second International Euroconference on High-Performance Marine Vehicles,, HIPER '01, Hamburg, Germany, May 2-5, 2001, pp. 480-491.

Tao Jiang, Rupert Henn, Som Deo Sharma, "Wash waves generated by ships moving on fairways of varying topography," presented at the Twenty-Fourth Symposium on Naval Hydrodynamics, Fukuoka, Japan, Jul. 8-13, 2002 (15 pages).

G.J. Macfarlane, M.R. Renilson, "When is low wash low wash?—An investigation using a wave wake database," presented at the International Conference on Hydrodynamics for High Speed Craft—Wake Wash and Motions Control, Royal Institution of Naval Architects (RINA), London, England, Nov. 7-8, 2000 (14 pages).

G.J. Macfarlane, M.R. Renilson, "Wave wake—A rational method for assessment," presented at the International Conference on Coastal Ships and Inland Waterways, Royal Institution of Naval Architects (RINA), London, England, Feb. 1999 (15 pages).

WAKE WASH SEVERITY MONITOR FOR HIGH SPEED VESSELS

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

The present invention relates to waves generated by marine vessels, more particularly to methodologies for controlling or preventing potentially hazardous wake wash conditions such as are caused by marine vessels traveling at high speeds in shallow waters.

Increasing numbers of high speed ferries are navigating coastal and inland waterways. In addition, both commercial and military entities are developing other types of vessels, particularly large displacement vessels, for operation in shallow waters such as coastal and littoral waters. The wake wash caused by vessels traveling in shallow waters represents both an environmental threat and a safety threat. The potential for damage and injury caused by wake wash is real. Wake wash created by vessels navigating shallow waters can result in shoreline erosion, structural damage, human injury or loss of life. Wake wash can wreak havoc on beaches, sand banks and sea walls and on property in such locales. Wake wash can unexpectedly arise on a calm day, thus posing a risk to people in the vicinity who are caught unawares.

The United States and other countries have responded to wake wash risks in various ways, including speed restrictions, ferry scheduling, breaking wave height standards, risk assessments for prospective operator licensees, legal actions, and public protests. The most prevalent approaches to limiting wake wash are based entirely on speed limits for specific near-shore regions. Such approaches to wake wash mitigation tend to miss some areas in need of speed restrictions. Furthermore, the speed limits imposed may be excessively or unnecessarily restrictive.

Wake wash waves created by a vessel are a function of vessel speed and water depth. It is generally accepted principle—and testing has shown—that the worst, most damaging wake wash waves are generated at or around a Froude depth number of 1.0. The Froude depth number equals the quantity vessel speed divided by the square root of the product water depth times gravitational constant. That is, the Froude depth number $Fn_d$ is calculated using the formula $$Fn_d = V \times (d \times g)^{-0.5}$$

where V is the vessel speed, d is the water depth and g is the gravitational constant. The term "critical speed" has been used to describe a speed resulting in a Froude depth number equal to one. The term "subcritical speed" has been used to describe a speed resulting in a Froude depth number less than one. The term "supercritical speed" has been used to describe a speed resulting in a Froude depth number greater than one.

Since the Froude depth number is a function of both vessel speed and water depth, wake wash alleviation measures that only take vessel speed into account represent—in principle and often in practice—an incomplete solution to the wake wash problem. The most common mitigative actions currently taken by regulatory bodies involve the mere imposition of speed limits. Speed limits fail to address the real issue of the physical relationship of wake wash with both vessel speed and water depth. Speed limits are not useful for every location; they can be either less restrictive or more restrictive than necessary, because the water depth is not taken into account.

Feldtmann U.S. Pat. No. 6,171,021, incorporated herein by reference, proposes physical alteration of the ocean floor. Feldtmann discloses a wake wash reduction approach involving the formation along a water bed of a "transition area" in which the natural water depth has been artificially altered through human engineering. Feldtmann asserts that, during the vessel's transition from subcritical speed to supercritical speed or from supercritical speed to subcritical speed, a vessel's speed can be adjusted while traveling in the transition area so as to avoid critical speed. Although Feldtmann discloses a solution having some conceptual validity insofar as both vessel speed and water depth are considered, his solution is not entirely realistic and does not lend itself to widespread practice.

The following references, informative on the subject of wake wash, are incorporated herein by reference: Trevor Whittaker, Bjorn Elsaber, "Coping with the wash: The nature of wash waves produced by fast ferries," *Ingenia*, quarterly of the Royal Academy of Engineering, Issue 11, Feb. 2002, pages 40–44; Trevor Whittaker, A. Bell, M. Shaw, K. Patterson, "An investigation of fast ferry wash in confined waters," paper no. 13, presented at the International Conference of Hydrodynamics of High Speed Craft, Royal Institution of Naval Architects (RINA), London, 24–25 Nov. 1999 (13 pages); I. W. Dand, T. A. Dingham-Peren, L. King, "Hydrodynamic aspects of a fast catamaran operating in shallow water," paper no. 11, presented at the International Conference of Hydrodynamics of High Speed Craft, Royal Institution of Naval Architects (RINA), London, 24–25 Nov. 1999 (17 pages); Alan Blume, "High-speed vessel wake wash," slide presentation presented at Ship Effects Workshop, U.S. Army Engineer Research and Development Center (ERDC), Gulfport, Miss., 29–30 Oct. 2002 (15 pages); "A physical study of fast ferry wash characteristics in shallow water," Final Report, Research Project 457, 2000, The Maritime and Coastguard Agency (United Kingdom), Nov. 2001 (115 pages); R Allen and R. Clements, "Ship wash impact management (SWIM)," presented at the Sixth International Conference on Fast Sea Transportation (FAST 2001), Royal Institution of Naval Architects (RINA), London, Sep. 2001, pages 91–96; R. Doyle, T. Whittaker, B. Elsaber, "A Study of Fast Ferry Wash in Shallow Water," presented at the Sixth International Conference on Fast Sea Transportation (FAST 2001), Royal Institution of Naval Architects (RINA), London, Sep. 2001, pages 107–119.

SUMMARY OF THE INVENTION

In view of the foregoing, it is an object of the present invention to provide an improved methodology for reducing the potentiality and incidence of the harmful effects of wake wash.

The present invention—which can be embodied as a method, an apparatus and/or a computer program product—does indeed take into account both vessel speed and water depth, and does so uniquely. Uniquely featured by the present invention is the inclusion of water depth as an additional criterion (i.e., in addition to the vessel speed criterion) in setting speed restrictions. Further, the present invention uniquely avails itself of the Froude depth number in a vessel monitoring system.

According to typical embodiments of the inventive methodology, the operator of a high speed vessel is immediately alerted to vessel operation at speeds that lead to the largest and most destructive wake wash waves for a given environment, typically a near-shore or other shallow water environment. According to many inventive embodiments, a signal or alarm notifies the captain that the vessel is operating at a speed known to cause excessive wake wash in the marine location currently being navigated. As a usual consequence of such inventive notification, the captain reduces the speed of the vessel in order to avoid Froude depth number criticality. It is also possible, according to some inventive embodiments, that the inventively notified captain will choose to increase speed to avoid Froude depth number criticality. Most frequently, the captain's appropriate response is voluntary reduction in vessel speed immediately upon detection by the present invention that the vessel is operating at an impermissible speed, e.g., a speed leading to large wake wash waves for the current water depth. A time history of the calculated Froude depth number can be recorded for review by owners and operators and/or regulatory bodies that are empowered to impose sanctions.

In accordance with typical embodiments of the present invention, a method is provided for monitoring wake wash associated with navigation through shallow waters. The inventive method comprises: (a) selecting a Froude depth number acceptability limit; (b) measuring the speed of the vessel; (c) measuring the depth of the water below the vessel; and, (d) determining when the Froude depth number relating to the navigation of the vessel exceeds the Froude depth number acceptability limit. The "Froude depth number acceptability limit" represents the Froude depth number above which the wake wash associated with the navigation of a vessel is considered to represent a significant risk. The determination as to when the Froude depth number exceeds the Froude depth number acceptability limit includes calculating the Froude depth number relating to the navigation of the vessel. In such calculation a relationship is considered among the Froude depth number being calculated, the measured speed of the vessel, and the measured depth of the water below the vessel; according to usual inventive practice, this relationship is the equation of the Froude depth number being calculated to a quotient, the dividend of the quotient being the measured speed of the vessel, the divisor of the quotient being the square root of a product, the product being the measured depth of the water multiplied by the gravitational constant.

A federal, state, local, municipal, administrative, agency, regulatory or other governing or governmental body can practice the present invention in order to regulate the amount of wake wash associated with navigation through a region that is generally characterized by shallow water depth. The region can constitute all or part of a body of water, or all or part of each of plural bodies of water. A typical inventive method that is practicable by an official or authoritative body comprises: (a) assigning a limitative Froude depth number value to the region; (b) requiring the onboard utilization, by a vessel navigating the region, of apparatus including a vessel speed measurement device, a water depth measurement device and a processor connected to the vessel speed measurement device and the water depth measurement device; and, (c) requiring the operator of a vessel navigating the region to reduce the speed of the vessel when the navigational Froude depth number value is determined to exceed (or to equal or exceed) the limitative Froude depth number value. The limitative Froude depth number value represents the Froude depth number above which (or at or above which) the wake wash associated with the navigation of a vessel is considered to represent a significant risk. The required onboard utilization of the apparatus is for determination of when the navigational Froude depth number value exceeds (or equals or exceeds) the limitative Froude depth number value. The determination includes calculation of the navigational Froude depth number based on the measured vessel speed and the measured water depth.

Inventive practice can be of benefit to a variety of interests, including marine regulatory and enforcement bodies (e.g., the U.S. Coast Guard), commercial owners and operators of fast ferries and other vessel types, environmental groups, property owners in areas vulnerable to destructive wake wash, and people in general who enjoy occupying such vulnerable areas. Inventive practice will serve society not only by protecting it from harm but also by decreasing costly and time-consuming fines, litigation and repairs relating to wake wash damage or injury. Inventive apparatus can become approved or required equipment for vessels, by law or regulation, to limit wake wash created by fast ferries and other vessels operating in shallow water. Inventive practice can permit vessels to travel given areas at maximum speeds that do not significantly risk or invite wake wash-related damage or injury.

Regarding governmentally imposed restrictions, governing bodies can mandate use of inventive devices (e.g., as required bridge equipment) to enforce speeds on vessels in particular (e.g., littoral) areas, thereby protecting people, personal property and the environment in such areas. Inventive apparatus can be set or calibrated to meet regulatory or environmental restrictions by allowing for voluntary speed reductions as needed for particular environments. Governmental rules and regulations can be fine-tuned to address not only specific geographical locations but also various types and/or sizes of vessels. For instance, the Froude depth number limit—i.e., the Froude depth number value that a vessel is not permitted to exceed (or to either reach or exceed)—can be legally mandated at a first value (e.g., $Fn_d$=0.8) for vessels less than a certain weight (expressed, e.g., in tonnage), and at a second, different value (e.g., $Fn_d$=0.7) for all other vessels operating in a particular bay. Even in the absence of legally imposed rules, inventive practice will appeal to marine transportation companies wishing to stave off lawsuits for damage and injury caused by wake wash.

The present invention establishes a speed limit that is location-specific, since water depth is a location-specific characteristic of a body or bodies of water. The present invention's location specificity is advantageous as compared with customary approaches involving categorical or blanket impositions of speed limits that cover wide, general areas with little or no differentiation among the smaller, more specific locations. Not only can inventive speed limits be set to improve the accuracy of existing speed limits, but also to set speed limits where none currently exist. The present invention succeeds in limiting wake wash while maximizing vessel speed. Many inventive embodiments include computer means that are programmed to perform Froude depth number computations and to perform other functions, such as the logging of vessel speeds and corresponding locations over time. These types of time history reviews, inventively practiced, can facilitate the enforcement of wake wash guidelines and the apprehension of offenders.

Other objects, advantages and features of the present invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

DETAILED DESCRIPTION OF THE INVENTION

Referring now to the figures, the present invention's monitoring system operates during operation of the marine vessel. Typically, the inventive apparatus automatically activates from the moment that the vessel begins to operate; i.e., the inventive apparatus automatically commences operation when the vessel is underway. Alternatively, the inventive apparatus can be set to automatically activate at a particular time or vessel position, or to be manually switched to activation mode at human discretion.

Figure 1:
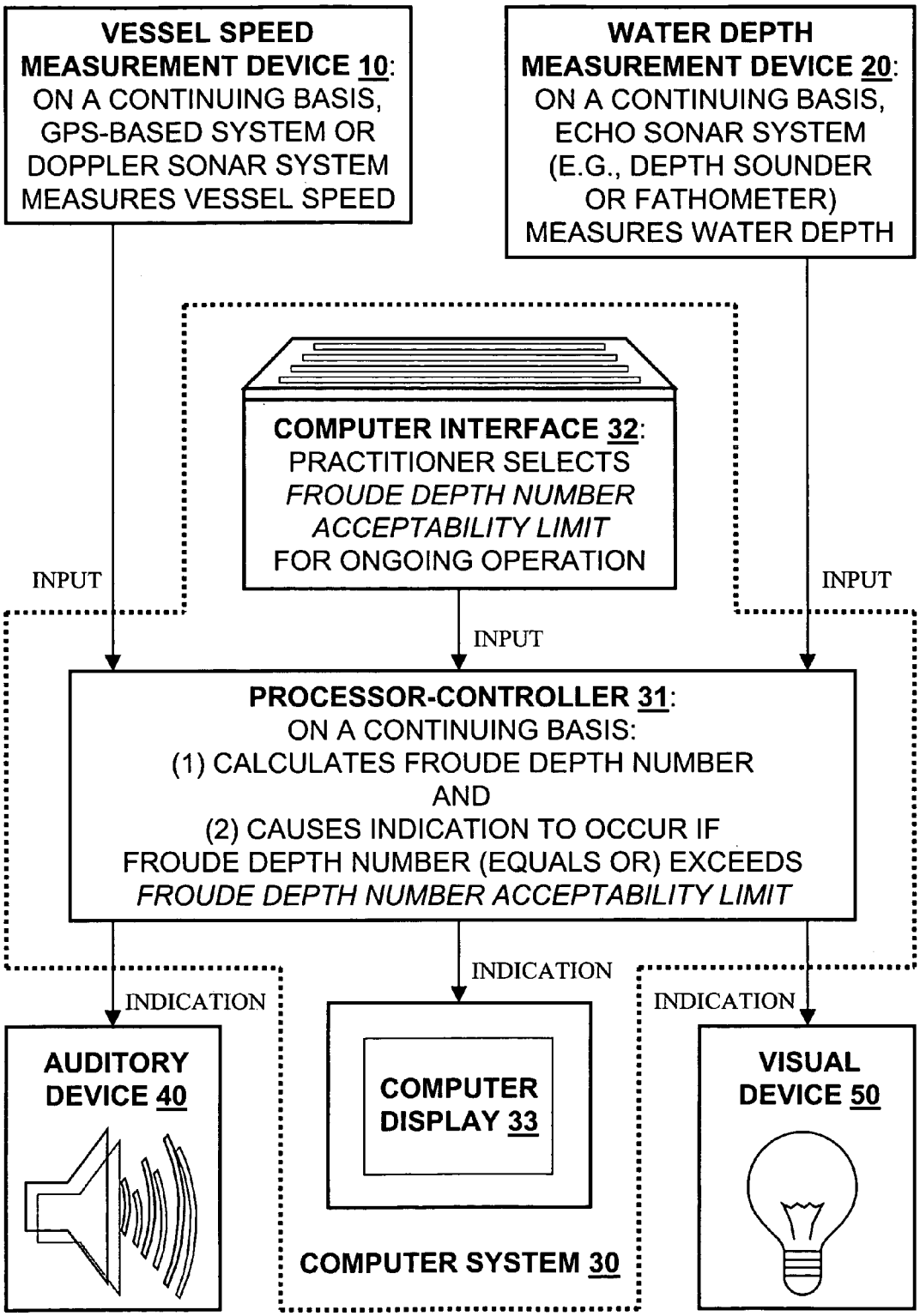
FIG. 1 is a schematic representation of method and apparatus in accordance with a typical embodiment of the present invention, such inventive embodiment providing for a "Froude depth number acceptability limit."
Figure 2:
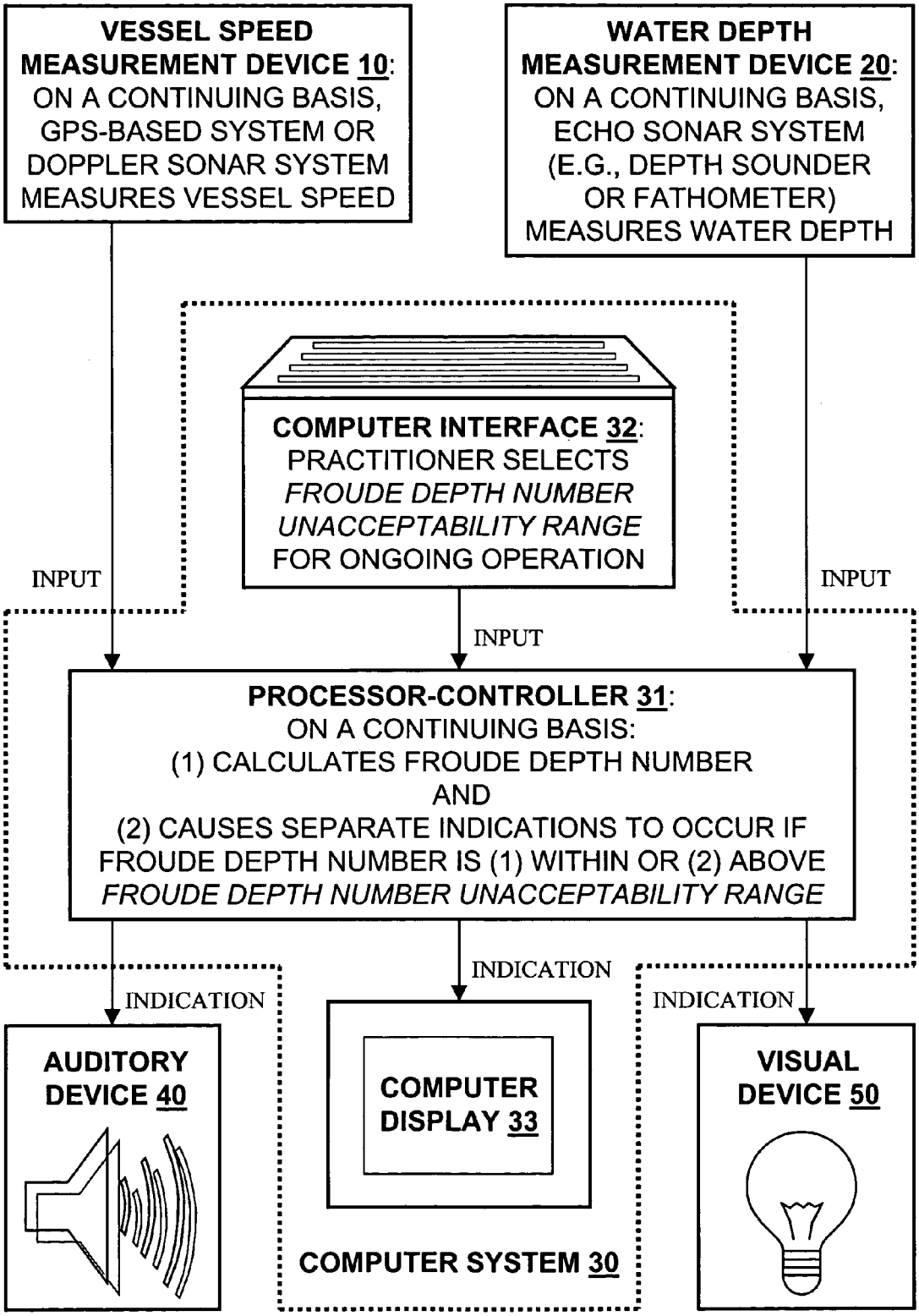
FIG. 2 is a schematic representation, similar to that shown in FIG. 1, of a typical inventive embodiment providing for a "Froude depth number unacceptability range."
Figure 3:
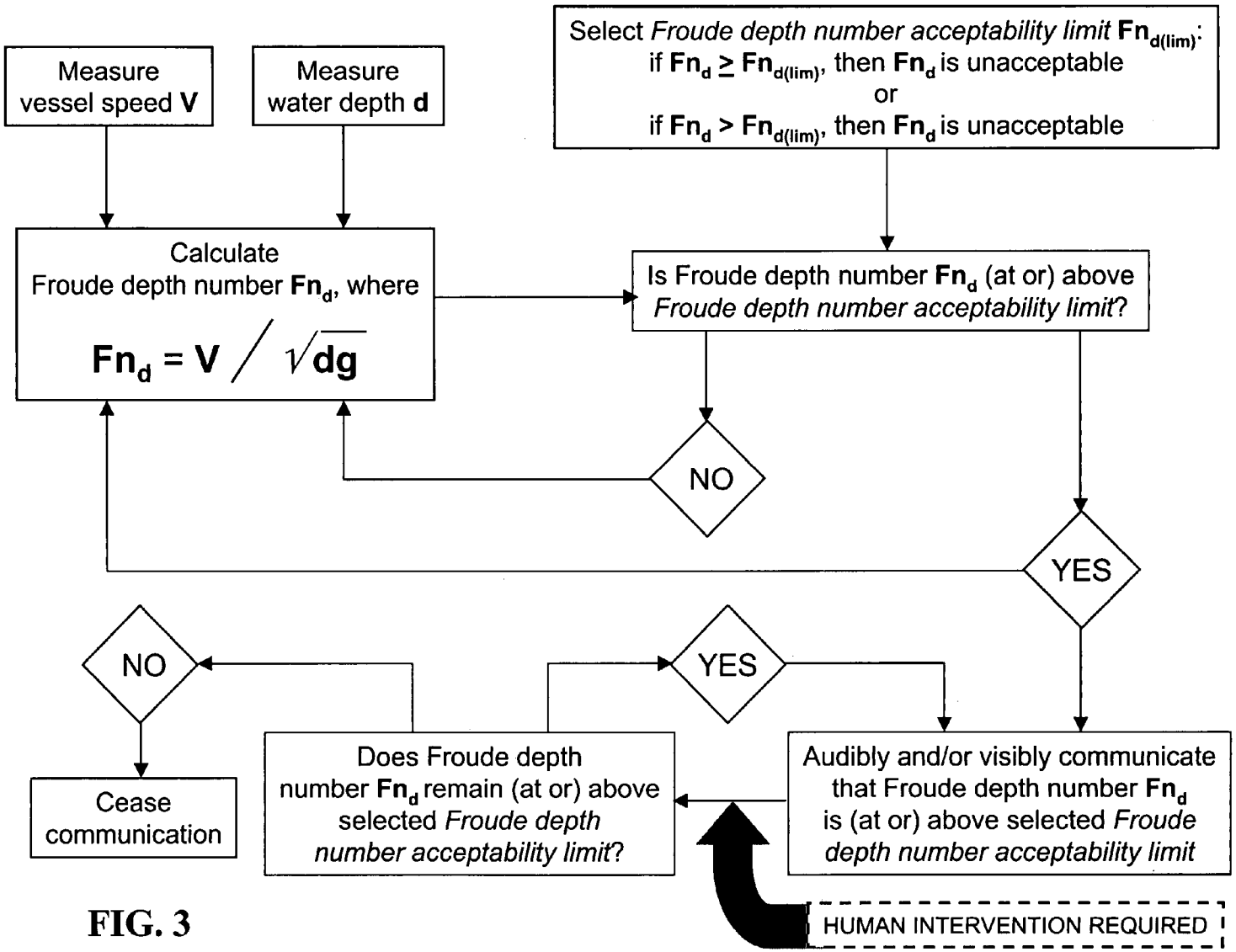
FIG. 3 is a block diagram, related to FIG. 1, illustrating computer logic in accordance with a typical embodiment of the present invention, such inventive embodiment providing for a "Froude depth number acceptability limit."
Figure 4:
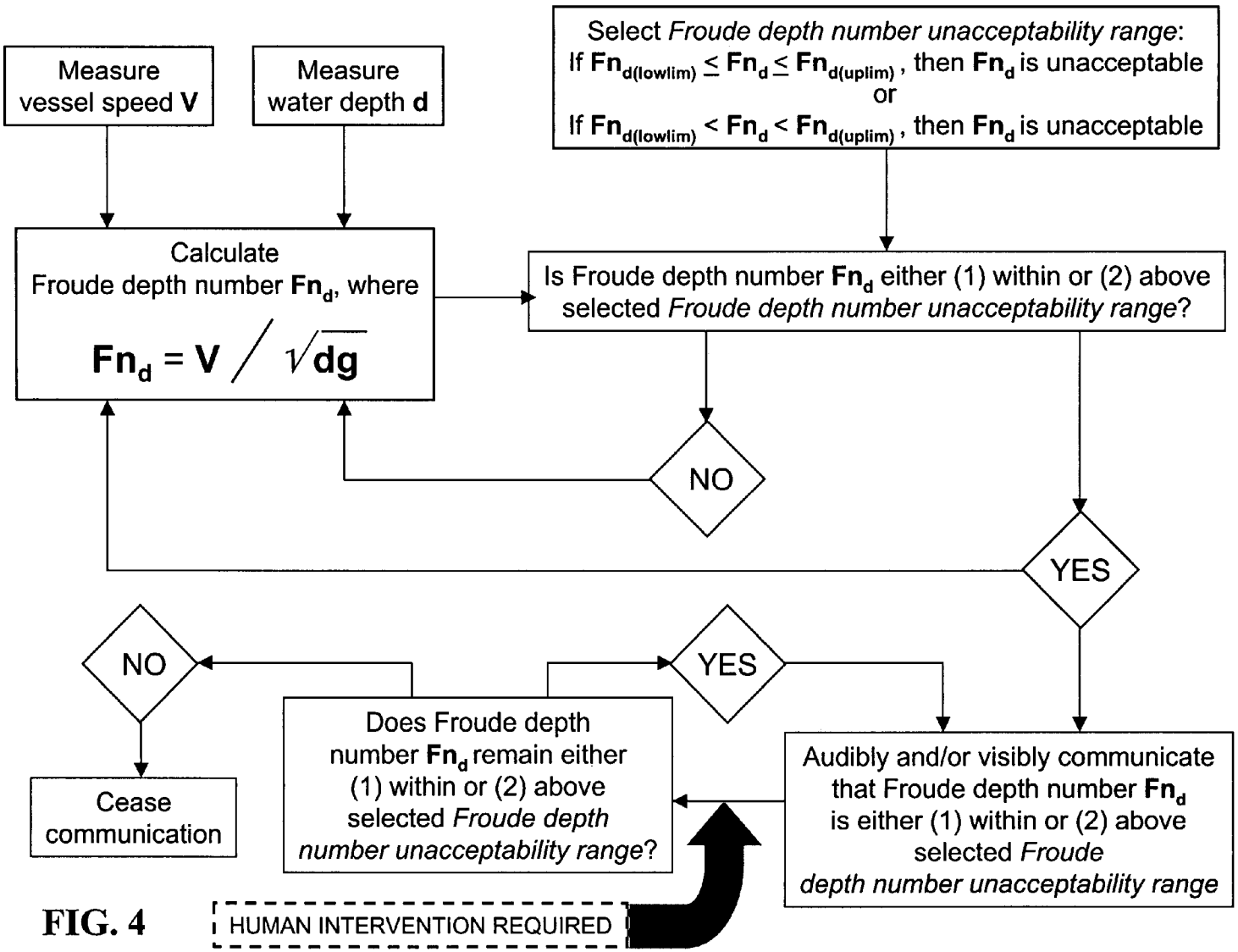
FIG. 4 is a block diagram, related to FIG. 2 and similar to that shown in FIG. 3, of a typical inventive embodiment providing for a "Froude depth number unacceptability range."
Figure 5:
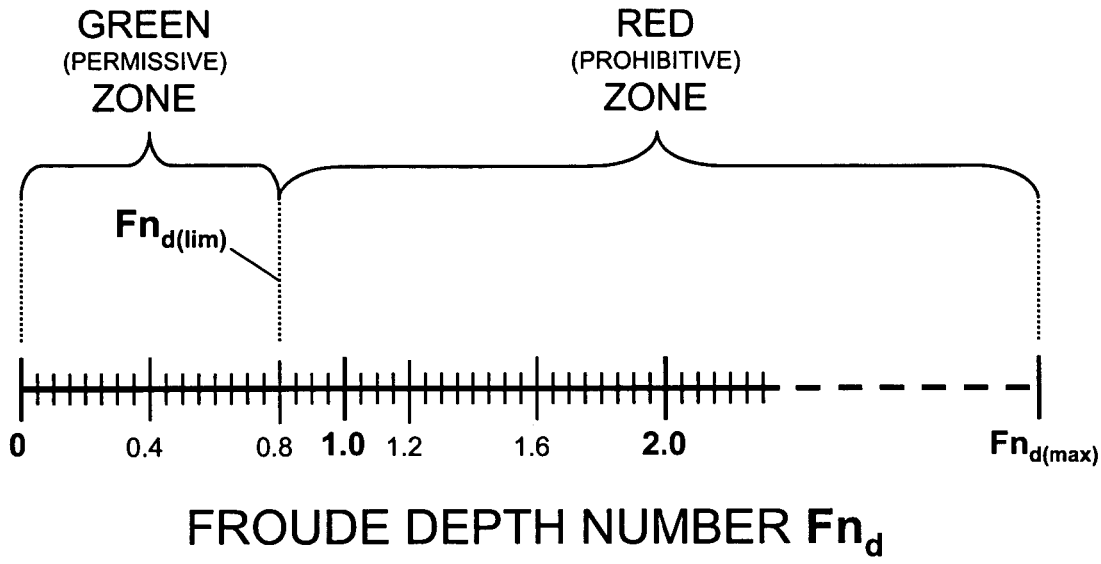
FIG. 5 is a graphical representation, related to FIG. 1 and FIG. 3, illustrating the two important ranges according to a typical inventive embodiment providing for a "Froude depth number acceptability limit" viz., the lower ("permissive") range and the higher ("prohibitive") range. Indication is inventively given when the Froude depth number achieved by the vessel falls within the prohibitive range.
Figure 6:
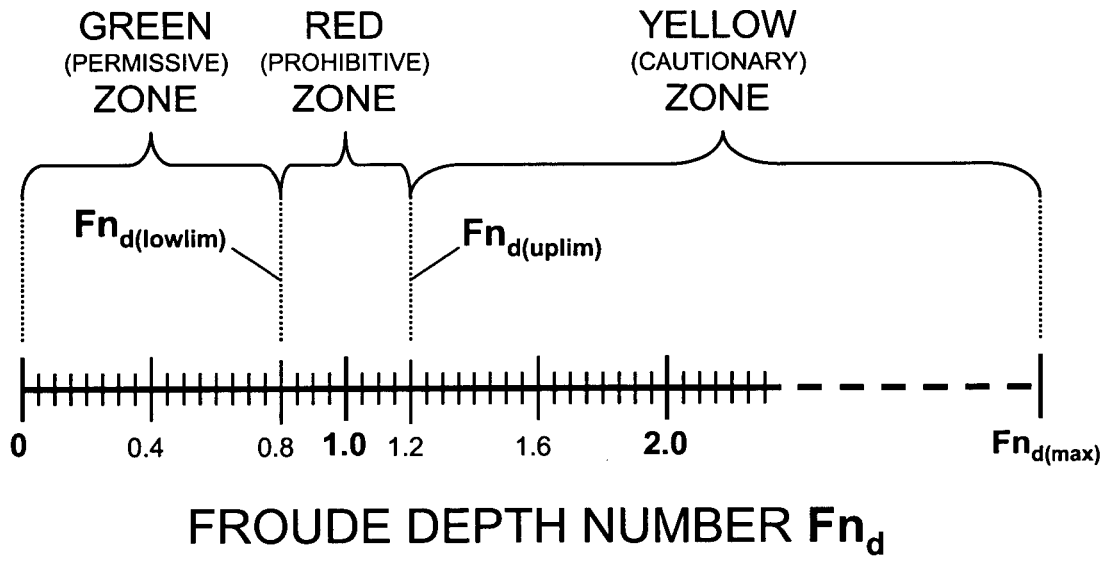
FIG. 6 is a graphical representation, related to FIG. 2 and FIG. 4, illustrating the three important ranges according to a typical inventive embodiment providing for a "Froude depth number unacceptability range," viz., the lowest ("permissive") range, the intermediate ("prohibitive" range), and the highest ("cautionary") range. One kind of indication is inventively given when the Froude depth number achieved by the vessel falls within the prohibitive range. Another, appreciably different kind of indication is inventively given when the Froude depth number achieved by the vessel falls within the cautionary range.

FIG. 1, FIG. 2 and FIG. 3 are similar to FIG. 4, FIG. 5 and FIG. 6, respectively. FIG. 1, FIG. 3 and FIG. 5 are illustrative of inventive embodiments wherein a single parametric Froude depth number (typically below 1.0) is set for processing. FIG. 2, FIG. 4 and FIG. 6 are illustrative of inventive embodiments wherein two parametric Froude depth numbers (typically, a lower Froude depth number that is less than 1.0, and a higher Froude depth number that is greater than 1.0) are set for processing. FIG. 3 and FIG. 4 are flow diagrams each illustrating the present invention's computer logic of processor 31, FIG. 3 illustrating a single parametric Froude depth number embodiment, FIG. 4 representing a double Froude depth number embodiment.

As shown in FIG. 1, FIG. 3 and FIG. 5, the inventive apparatus signals or warns when the actual Froude depth number achieved by the vessel is greater than (or equal to or greater than) the parametric Froude depth number set by the processor 31. As shown in FIG. 2, FIG. 4 and FIG. 6, the inventive apparatus signals or warns on two occasions (distinguishably so between the two occasions), viz.: (1) when the actual Froude depth number achieved by the vessel is within the prohibitive parametric range and (2) when the actual Froude depth number achieved by the vessel is above the prohibitive parametric range. The prohibitive parametric range is that range in which the actual Froude depth number is both: (i) greater than (or equal to or greater than) the lower parametric Froude depth number set by the processor; and, (ii) less than (or equal to or less than) the higher parametric Froude depth number set by the processor 31.

Particularly with reference to FIG. 1 and FIG. 2, the vessel is equipped onboard with instrumentation including a vessel speed measurement device 10, a water depth measurement device 20 and a computer system 30. Computer system 30 includes a data processor 31 (including a memory), a computer-human interface 32 (including a keyboard and a mouse as input devices for the user) and a computer display (including a monitor) 33. Optionally, the vessel is also provided, external or peripheral to computer system 30, with an auditory device 40 (such as a buzzer, bell or siren) and/or a visual device 50 (such as a flashing or blinking light).

Vessel speed measurement device 10 and water depth measurement device 20 are each connected to processor 31, which receives and processes information from devices 10 and 20. According to a typical doppler sonar device (e.g., an acoustic speedometer), paired transducers, attached to the vessel and pointing downward, are used obtain vessel speed based on the doppler shift of return signals from the bottom of the body of water. Some modern vessels are equipped with a satellite-based speed measurement system in which the vessel speed is ground-referenced using the Global Positioning System (GPS). Most conventional vessel depth measurement devices are echo sonar devices, variously known as echo sounders, fathometers, sonic depth finders, etc., such terms often being used interchangeably. Although technical distinctions may be drawn among various types of echo sonar devices, generally they share the principle whereby sonic or ultrasonic pulses or vibrations are emitted from a device attached to the vessel and are bounced back from the bottom of the water body; the distance traveled by the sound or ultrasound waves is calculated from the known speed of the emitted waves and from the measured time taken for the echo to return. Ordinarily skilled artisans are well acquainted with the various known instruments and techniques for measuring vessel speed, as well as for measuring water depth.

On an ongoing basis, while the vessel is moving through water, the inventive apparatus monitors the wake wash associated with the wave-generative movement of the vessel through the water. Device 10 measures the speed of the vessel. Device 20 measures the depth of the water beneath the vessel. Processor 31 assesses whether the wake wash associated with the movement of the vessel through the water represents a significant risk that damaging and/or injurious wake wash will ensue. This risk assessment by processor 31 includes functions and operations as elaborated upon hereinbelow.

At least one "parametric" Froude depth number is established (e.g., input in memory for processing availability). Each parametric Froude depth number demarcates between significant (or more significant) wake wash risk and insignificant (or less significant) wake wash risk. The "actual"

Froude depth number $Fn_d$ of the vessel is calculated in a continually updated fashion using the equation $Fn_d = V \times (d \times g)^{-0.5}$, wherein g is the gravitational constant. This calculation of $Fn_d$ uses the continually updated measured speed V of the vessel (measured by device 10) and the continually updated measured depth d of the water below the vessel (measured by device 20). In a continually updated fashion, the actual Froude depth number is compared with the parametric Froude depth number or numbers. Such comparison between actual Froude depth number and parametric Froude depth number(s) reveals the magnitude of the vessel's actual Froude depth number $Fn_d$ relative to each parametric Froude depth number (e.g., in terms of being greater than, or equal to, or less than). The parametric Froude depth number(s) can be a single parametric Froude depth number $Fn_{d(lim)}$, or a pair of parametric Froude depth numbers $Fn_{d(lowlim)}$ and $Fn_{d(uplim)}$, or some other version or combination of one or more parametric Froude depth numbers.

Whenever this comparison of actual Froude depth number versus parametric Froude depth number(s) leads processor 31 to the conclusion that wake wash risk is significant—the actual Froude depth number falling within a wake wash risk category describing some form of significant risk—processor 31 causes indication of such risky condition via the visual display 33 of computer 30, and/or via a sound-emanative device 40 (which emanates buzzing, ringing, siren sound or other auditory indication), and/or via a light-emanative device 50 (which emanates flashing, blinking or other visual indication). Auditory means 40 can include a peripheral sound system of computer 30, or some external acoustic device (e.g., bell, buzzer, siren, etc.), or some combination thereof. Visual means 40 usually will include, at least, the visual display (e.g., monitor) 33 that is part of computer system 30. In addition (or in the alternative), visual means 40 can include one or more devices providing visual indicia, e.g., via constant, flashing and/or blinking illumination. The present invention is often practiced whereby processor 31 causes one or more devices external to computer 30 to give acoustic and/or electromagnetic indication of high/significant wake wash risk, processor 31 thereby serving, in a sense, as both a processor and a controller.

The inventive programming can provide for either a "Froude depth number acceptability limit" or a "Froude depth number unacceptability range." For most applications of the present invention, the "Froude depth number acceptability limit" mode of inventive practice (depicted in FIG. 1, FIG. 3 and FIG. 5) will be sufficient, and may even be preferable in its relative simplicity to the "Froude depth number unacceptability range" mode of inventive practice (depicted in FIG. 2, FIG. 4 and FIG. 6). An advantage of Froude depth number unacceptability range embodiments, as contrasted with Froude depth number acceptability limit embodiments, is the affording of a more exacting or refined indication as to the current Froude depth number status of the vessel. A typical navigational scenario is one in which a vessel approaches a coastline (bordered by shallow water) while traveling at a high rate of speed, achieving a Froude depth number well below one because of the great depth of the non-coastline (e.g., deep sea) waters. Rather than gradually decrease in water depth (thus tending to result in a gradual increase in Froude depth number), the water depth might abruptly or precipitously decrease near the coastline. A period of time exists, during this rapid or instantaneous transition from deep to shallow water, in which the vessel's Froude depth number is well above one. It is useful to inventively inform the vessel operator that the vessel is currently above the Froude depth number danger zone for wake wash, and that when the vessel decelerates it will enter and pass through this danger zone, thus affording the vessel operator a better perspective regarding the timing of the circumstances and the ramifications of the moment.

Regardless of whether the present invention is practiced in two-zone mode (i.e., red zone, green zone) or in three-zone mode (i.e., yellow zone, red zone, green zone), the clear message of a warning (whether a yellow zone warning or a red zone warning) is that the vessel has entered shallow waters. Regardless of whether the vessel is traveling in the yellow zone or the red zone, the action taken in response to warning will normally include vessel speed reduction in at least part of the duration of transit through the warning zone or zones. Thus, in two-zone embodiments, the sea captain will normally reduce speed at some point or for some period in response to a red zone warning. In three-zone embodiments, the sea captain will normally reduce speed at some point or for some period in response to either a yellow zone warning or a red zone warning or both zone warning types. Nevertheless, a three-zone inventive system—one which notifies as to a "yellow" (cautionary") condition in which passage through the red zone is imminent or impending—affords the experienced sea captain a better opportunity to respond to warning so as to attenuate or minimize wake wash risk associated with the red zone. For instance, while the vessel is in the yellow zone, the sea captain can begin to undertake intricate maneuvers involving adjustments in speed and direction (e.g., hug the coastline, circle the harbor, etc.) so as to render the virtually inevitable passage of the vessel through the red zone as risk-free as possible.

With reference to FIG. 1, FIG. 3 and FIG. 5, a Froude depth number acceptability limit $Fn_{d(lim)}$ is a parametric Froude depth number, typically subcritical (i.e., less than one), delineating between lower, permissible Froude depth numbers $Fn_d$ and higher, impermissible Froude depth numbers $Fn_d$. In inventive practice, a typical Froude depth number acceptability limit $Fn_{d(lim)}$ will be set (e.g., at the instance of a regulatory body) at 0.8 or approximately so. As shown in FIG. 5, the Froude depth number acceptability limit $Fn_{d(lim)}$ delineates between a "permissive" zone (also referred to herein as the "green" zone) and a "prohibitive" zone (also referred to herein as the "red" zone). The green zone is situated below, or at and below, the Froude depth number acceptability limit; that is, the green zone is bounded by zero and the Froude depth number acceptability limit. The red zone is situated above, or at and above, the Froude depth number acceptability limit; that is, the red zone is bounded by the Froude depth number acceptability limit and a maximum, undefined limit $Fn_{d(max)}$. The red zone is upwardly self-limiting, undefined limit $Fn_{d(max)}$, since the water depth can be assumed to be greater than zero.

With reference to FIG. 2, FIG. 4 and FIG. 6, a Froude depth number unacceptability range is a range between two parametric Froude depth numbers, viz., a lower parametric Froude depth number $Fn_{d(lowlim)}$ and an upper parametric Froude depth number $Fn_{d(uplim)}$. The lower parametric Froude depth number $Fn_{d(lowlim)}$, typically subcritical (i.e., less than one), is equivalent to the aforementioned Froude depth number acceptability limit $Fn_{d(lim)}$. As shown in FIG. 5, the lower parametric Froude depth number $Fn_{d(lowlim)}$ delineates between lower, permissible Froude depth numbers $Fn_d$ (i.e., the permissive or green zone) and higher, impermissibles Froude depth numbers $Fn_d$ (i.e., the prohibitive or red zone). The upper parametric Froude depth number $Fn_{d(uplim)}$, typically supercritical (i.e., greater than one), delineates between the red zone and higher Froude depth numbers $Fn_d$ representing the "cautionary zone" (also referred to herein as the "yellow zone"). In inventive practice, a typical upper parametric Froude depth number $Fn_{d(uplim)}$ will be set (e.g., at the instance of a regulatory body) at 1.2 or approximately so.

Depending on the inventive embodiment of Froude depth number acceptability limit mode, a permissible Froude depth number $Fn_d$ is defined to be either (i) less than $Fn_{d(lim)}$, or (ii) less than or equal to $Fn_{d(lim)}$; an impermissible Froude depth number $Fn_d$ is defined to be either (i) greater than $Fn_{d(lim)}$, or (ii) greater than or equal to $Fn_{d(lim)}$. As a practical matter, whether the definition of a permissible Froude depth number $Fn_d$ is $Fn_d<Fn_{d(lim)}$, or $Fn_d \leqq Fn_{d(lim)}$, is a distinction without a difference, the significance lying mainly in the logic or mathematics of the programming itself. It is of little or no practical import (other than with regard to the inventive computer programming) whether a "less than" or "less than or equal to" formulation is used, or whether a "greater than" or "greater than or equal to" formulation is used. Thus, according to inventive Froude depth number unacceptability range mode, a Froude depth number $Fn_d$ unacceptability range can be defined as $Fn_{d(lowlim)}<Fn_d<Fn_{d(uplim)}$, or $Fn_{d(lowlim)} \leqq Fn_d \leqq Fn_{d(uplim)}$, or $Fn_{d(lowlim)} \leqq Fn_d<Fn_{d(uplim)}$, or $Fn_{d(lowlim)}<Fn_d \leqq Fn_{d(uplim)}$.

During navigation of the vessel, processor 31 is capable of receiving continual speed measurements, receiving continual depth measurements, rendering continual calculations of the actual Froude depth number, and causing indication (via., display 33 and/or auditory device 40 and/or visual device 50) that the wake wash associated with navigation of the vessel represents significant wake wash risk. During navigation of the vessel, processor 31 is further capable of causing the cessation of the indication when the wake wash associated with navigation of the vessel ceases to represent significant wake wash risk. In other words, at any time that the magnitude of the actual Froude depth number falls inside the bounds of impermissible Froude depth number territory, the indication means is active. At any time that the magnitude of the actual Froude depth number falls outside the bounds of impermissible Froude depth number territory, the indication means is inactive. For instance, processor 31 can either refrain from activating an inactive indication means, or inactivate an active indication means. Most inventive embodiments provide for a simple "on-off" indication means: When the indication means is on, the wake wash risk is significant; when the indication means is off, the wake wash risk is insignificant. Some inventive embodiments, however, provide for the indication means to give two or three kinds of indications, e.g., a green light for the green zone, a red light for the red zone, and a yellow light for the yellow zone (for an inventive embodiment in Froude depth number unacceptability range mode).

According to many inventive embodiments, processor 31 records wake wash-related data in its memory on a continuing basis, accessible, e.g., via display 33 or a printer. Display 33 can display a running readout of the continually changing actual Froude depth number, and can further indicate how the Froude depth number is categorized in terms of wake wash risk. The data can be recorded and/or displayed at set intervals, e.g., in milliseconds, seconds or minutes. The time history can include the calculated Froude depth number, the continual changing of which is reflected in the intermittent recordation. The prevailing condition of high risk wake wash condition versus low risk wake wash can be recorded in a similar manner.

The present invention is readily implemented regardless of the nature and extent of the existing onboard hardware and software (if any) with which the vessel is already equipped. In each of these scenarios, one or more visual and/or auditory devices can be included in the inventive monitoring system, supplemental to the most important inventive apparatus, namely, a vessel speed measurer, a water depth measurer and a computer system (typically including a data processor, an interface unit and a display).

Most commonly, the vessel will already be equipped with vessel speed measurement capability (e.g., a device employing the Global Positioning System, or a Doppler sonar device), water depth measurement capability (e.g., a depth sounder or fathometer), computer capability and navigational software. In these vessels, the existing sensor/transducer hardware already renders vessel speed and water depth measurements that are tracked and displayed by navigation or bridge control software that is resident in the computer. Under such circumstances, the present invention can be incorporated into the overall electronics of the vessel through (or primarily through) a software upgrade that includes inventive capabilities, typically including the computation, display and recordation of the Froude depth number and the indication (e.g., displayed, sounded and/or signaled) when the vessel is operating at an impermissible speed (e.g., a speed that causes large wake wash waves).

Less commonly, a vessel will lack some form of critical hardware, such as vessel speed measurement means and/or water depth measurement means and/or computer means. Even if the vessel is equipped with these capabilities, the vessel can lack navigational software. Under such circumstances, inventive implementation can include a partial upgrade such as involving a relatively simple hardware package that includes the missing vessel speed measurement component and/or the water depth measurement component and/or the computer system component, combined with either (i) an inventive software upgrade for an existing computer system or (ii) a new, independent computer system (including processor, interface and display) having inventive software installed in its memory. Even less commonly, a marine vessel may be totally lacking in vessel speed and water depth and computer capabilities. Under such circumstances, inventive implementation would involve a complete installation. The complete upgrade Would involve a relatively simple hardware package including all of the missing components, viz., the vessel speed measurement component, the water depth measurement component, and the computer component having inventive software installed in its memory.

The present invention represents a highly effective and practical solution, albeit not a perfect solution, to the wake wash problem. The present invention can be expanded or amplified to include the onboard monitoring of such factors as vessel power output, vessel displacement and vessel draft, and to include consideration of such additional factors, not monitored onboard, as nearby waterline boundary factor (e.g., slope, shelves, soil, wall), beach usage factor (e.g., remote versus developed area), environmental sensitivity factor (e.g., rare or fragile species), and severe weather factor. The vessel power output, vessel displacement and vessel draft can be incorporated into inventive software to provide a more comprehensive and more exacting computer program.

The present invention is not to be limited by the embodiments described or illustrated herein, which are given by way of example and not of limitation. Other embodiments of the present invention will be apparent to those skilled in the art from a consideration of this disclosure or from practice of the present invention disclosed herein. Various omissions, modifications and changes to the principles disclosed herein may be made by one skilled in the art without departing from the true scope and spirit of the present invention, which is indicated by the following claims.

What is claimed is:

1. A method for monitoring wake wash associated with navigation through shallow waters, said method comprising selecting a Froude depth number acceptability limit, said Froude depth number acceptability limit representing the Froude depth number above which the wake wash associated with the navigation of a vessel is considered to represent a significant risk, said method further comprising, during the navigation of a vessel:

measuring the speed of the vessel;

measuring the depth of the water below the vessel;

determining when the Froude depth number relating to the navigation of the vessel exceeds said Froude depth number acceptability limit, said determining including calculating the Froude depth number relating to the navigation of the vessel, said calculating including considering a relationship among the Froude depth number being calculated, the measured speed of the vessel, and the measured depth of the water below the vessel; and communicating when the Froude depth number relating to the navigation of the vessel is determined to exceed said Froude depth number acceptability limit.

2. The method of claim 1, wherein according to the relationship the Froude depth number being calculated is equal to a quotient, the dividend of the quotient being the measured speed of the vessel, the divisor of the quotient being the square root of a product, the product being the measured depth of the water multiplied by the gravitational constant.

3. The method of claim 1, wherein:

said Froude depth number acceptability limit pertains toga subject region of water; and said measuring of speed, said measuring of depth, and said determining are performed during navigation of the vessel in the subject region of water.

4. The method of claim 1, wherein said measuring of speed, said measuring of depth, and said determining are performed on an at least substantially continuous basis during navigation of the vessel.

5. The method of claim 1, further comprising communicating when the Froude depth number relating to the navigation of the vessel is determined to equal said Froude depth number acceptability limit.

6. The method of claim 1, wherein:

said Froude depth number acceptability limit is a lower Froude depth number acceptability limit;

said method further comprises selecting an upper Froude depth number acceptability limit, said upper Froude depth number acceptability limit representing the Froude depth number below which the wake wash associated with the navigation of a vessel is considered to represent a significant risk; and said lower Froude depth number acceptability limit and said upper Froude depth number acceptability limit together delimit a Froude depth number unacceptability range, said Froude depth number unacceptability range being a range in which the wake wash associated with the navigation of a vessel is considered to represent a significant risk;

said method further comprises determining when the Froude depth number relating to the navigation of the vessel is determined not to exceed said upper Froude depth number acceptability limit;

said determining regarding said lower Froude depth number acceptability limit and said determining regarding said upper Froude depth number acceptability limit together determine when the Froude depth number relating to the navigation of the vessel is in said Froude depth number unacceptability range;

said method further comprises communicating when either of the following occurs: when the Froude depth number relating to the navigation of the vessel is determined to be in said Froude depth number unacceptability range; and when the Froude depth number relating to the navigation of the vessel is determined to be above said Froude depth number unacceptability range; and said communicating when the Froude depth number is determined to be in said Froude depth number unacceptability range is distinguishable from said communicating when the Froude depth number is determined to be above said Froude depth number unacceptability range.

7. Apparatus for monitoring wake wash associated with navigation through shallow waters, said method comprising:

means for measuring the speed of a vessel;

means for measuring the depth of the water beneath the vessel; and means for assessing whether the wake wash associated with navigation of the vessel represents significant wake wash risk, said assessing including:

establishing at least one parametric Froude depth number, each said parametric Froude depth number demarcating between significant wake wash risk and insignificant wake wash risk;

calculating the actual Froude depth number of the vessel using the measured speed of the vessel and the measured depth of the water below the vessel;

comparing said actual Froude depth number with said at least one parametric Froude depth number; and means for indicating that the wake wash associated with navigation of the vessel represents significant wake wash risk.

8. The apparatus of claim 7, wherein said means for indicating includes at least one of auditory indication means and visual indication means.

9. The apparatus of claim 7, wherein said actual Froude depth number is calculated as equaling a quotient, the dividend of the quotient being the measured speed of the vessel, the divisor of the quotient being the square root of a product, the product being the measured depth of the water multiplied by the gravitational constant.

10. The apparatus of claim 7, wherein said at least one parametric Froude depth number includes a primary parametric Froude depth number, said primary parametric Froude depth number representing the Froude depth number below which wake wash risk is insignificant wake wash risk and at and above which wake wash risk is significant wake wash risk.

11. The apparatus of claim 7, wherein said at least one parametric Froude depth number includes a primary parametric Froude depth number, said primary parametric Froude depth number representing the Froude depth number at and below which wake wash risk is insignificant wake wash risk and above which wake wash risk is significant wake wash risk.

12. The apparatus of claim 7, wherein said at least one parametric Froude depth number includes a lower parametric Froude depth number and an upper parametric Froude depth number, said lower parametric Froude depth number representing the Froude depth number below which wake wash risk is insignificant wake wash risk and at and above which wake wash risk is significant wake wash risk, said upper parametric Froude depth number representing the Froude depth number at and below which wake wash risk is presently significant wake wash risk and above which wake wash risk is impendently significant wake wash risk, said lower parametric Froude depth number and said upper parametric Froude depth number thereby delimiting a range of said presently significant wake wash risk, said means for indicating including means for indicating:

that the wake wash associated with navigation of the vessel represents presently significant wake wash risk; and that the wake wash associated with navigation of the vessel represents impendently significant wake wash risk.

13. The apparatus of claim 7, wherein said at least one parametric Froude depth number includes a lower parametric Froude depth number and an upper parametric Froude depth number, said lower parametric Froude depth number representing the Froude depth number at and below which wake wash risk is insignificant wake wash risk and above which wake wash risk is significant wake wash risk, said upper parametric Froude depth number representing the Froude depth number below which wake wash risk is presently significant wake wash risk and at and above which wake wash risk is impendently significant wake wash risk, said lower parametric Froude depth number and said upper parametric Froude depth number thereby delimiting a range of said presently significant wake wash risk, said means for indicating including means for indicating:

that the wake wash associated with navigation of the vessel represents presently significant wake wash risk; and that the wake wash associated with navigation of the vessel represents impendently significant wake wash risk.

14. The apparatus of claim 7, wherein said at least one parametric Froude depth number includes a lower parametric Froude depth number and an upper parametric Froude depth number, said lower parametric Froude depth number representing the Froude depth number below which wake wash risk is insignificant wake wash risk and at and above which wake wash risk is significant wake wash risk, said upper parametric Froude depth number representing the Froude depth number below which wake wash risk is presently significant wake wash risk and at and above which wake wash risk is impendently significant wake wash risk, said lower parametric Froude depth number and said upper parametric Froude depth number thereby delimiting a range of said presently significant wake wash risk, said means for indicating including means for indicating:

that the wake wash associated with navigation of the vessel represents presently significant wake wash risk; and that the wake wash associated with navigation of the vessel represents impendently significant wake wash risk.

15. The apparatus of claim 7, wherein said at least one parametric Froude depth number includes a lower parametric Froude depth number and an upper parametric Froude depth number, said lower parametric Froude depth number representing the Froude depth number at and below which wake wash risk is insignificant wake wash risk and above which wake wash risk is significant wake wash risk, said upper parametric Froude depth number representing the Froude depth number at and below which wake wash risk is presently significant wake wash risk and above which wake wash risk is impendently significant wake wash risk, said lower parametric Froude depth number and said upper parametric Froude depth number thereby delimiting a range of said significant wake wash risk, said means for indicating including means for indicating:

that the wake wash associated with navigation of the vessel represents presently significant wake wash risk; and that the wake wash associated with navigation of the vessel represents impendently significant wake wash risk.

16. The apparatus of claim 7, wherein:

each said parametric Froude depth number pertains to at least one region describing at least a portion of at least one body of water; and said assessing is performed on an at least substantially continuous basis during navigation of the vessel in the at least one region.

17. The apparatus of claim 7, wherein:

said means for assessing includes a processor having a memory; and during navigation of the vessel said processor is capable of receiving continual speed measurements, receiving continual depth measurements, rendering continual calculations of said actual Froude depth number, causing indication that the wake wash associated with navigation of the vessel represents significant wake wash risk, and causing the cessation of said indication when the wake wash associated with navigation of the vessel ceases to represent significant wake wash risk.

18. The apparatus of claim 17, wherein:

said means for measuring the speed includes at least one of a Global Positioning System device and a doppler sonar device;

said means for measuring the depth includes an echo sonar device; and said means for indicating includes at least one of a computer display, a light signal and a sound alarm.

19. A computer program product comprising a computer useable medium having computer program logic recorded thereon for enabling a computer to process data pertaining to wake wash risk associated with waves generated by a vessel, said computer including a display, said computer program logic comprising:

means for enabling the computer to access at least one threshold Froude depth number, each said threshold Froude depth number delineating between a high risk wake wash condition and a low risk wake wash condition that are associated with waves generated by a vessel;

means for enabling the computer to access, on a continuing basis, the measured speed of the vessel;

means for enabling the computer to access, on a continuing basis, the measured depth of the water beneath the vessel;

means for enabling the computer to determine, on a continuing basis, whether the prevailing wake wash condition is a high risk wake wash condition, said means for enabling the computer to determine including:

means for enabling the computer to calculate, on a continuing basis, the Froude depth number of the vessel as equal to a quotient, the dividend of the quotient being the measured speed of the vessel, the divisor of the quotient being the square root of a product, the product being the measured depth of the water multiplied by the gravitational constant;

means for enabling the computer to relate, on a continuing basis, said calculated Froude depth number to said at least one threshold Froude depth number; and means for enabling said display to indicate that the prevailing wake wash condition is a high risk wake wash condition.

20. The computer program product of claim 19, wherein said computer is connected to at least one of an audio signaling device and a visual signaling device, and wherein said computer program logic further comprising means for enabling the computer to cause said at least one of an audio device and a visual device to indicate that the prevailing wake wash condition is a high risk wake wash condition.

21. The computer program product of claim 19, wherein said computer program logic further comprising means for enabling said display to indicate, on a continuing basis, at least one of the following:

said calculated Froude depth number;

whether the prevailing wake wash condition is a high risk wake wash condition.

22. The computer program product of claim 19, wherein said computer includes a memory, and wherein said computer program logic further comprising means for enabling said computer to record in its memory, on a continuing basis, at least one of the following:

said calculated Froude depth number;

whether the prevailing wake wash condition is a high risk wake wash condition.

23. A method for regulating the amount of wake wash associated with navigation through a region constituting at least part of each of at least one body of water, said region being generally characterized by shallow water depth, said method comprising:

assigning a limitative Froude depth number value to a region, said limitative Froude depth number value representing the Froude depth number above which, or at or above which, the wake wash associated with the navigation of a vessel is considered to represent a significant risk;

requiring the onboard utilization, by a vessel navigating said region, of apparatus including a vessel speed measurement device, a water depth measurement device and a processor connected to said vessel speed measurement device and said water depth measurement device, wherein said apparatus is to be utilized for determining when the navigational Froude depth number value exceeds, or equals or exceeds, said limitative Froude depth number value, said determining including calculating said navigational Froude depth number based on the measured vessel speed and the measured water depth; and requiring the operator of a vessel navigating said region to reduce the speed of the vessel when the navigational Froude depth number value is determined to exceed, or to equal or exceed, said limitative Froude depth number value.

* * * * *